US007100491B2

(12) United States Patent
Yatsko et al.

(10) Patent No.: US 7,100,491 B2
(45) Date of Patent: Sep. 5, 2006

(54) FLUID-POWERED MECHANICAL ACTUATOR AND METHOD FOR CONTROLLING

(76) Inventors: Joseph S. Yatsko, 2564 Babcock Rd., Hinckley, OH (US) 44233; Dawn E. Yatsko, 2564 Babcock Rd., Hinckley, OH (US) 44233

( * ) Notice: Subject to any disclaimer, the term of this patent is extended or adjusted under 35 U.S.C. 154(b) by 0 days.

(21) Appl. No.: 11/145,609

(22) Filed: Jun. 6, 2005

(65) Prior Publication Data

US 2005/0241472 A1 Nov. 3, 2005

Related U.S. Application Data

(63) Continuation of application No. 10/281,505, filed on Oct. 29, 2002, now Pat. No. 6,901,840.

(51) Int. Cl.
*F01B 19/04* (2006.01)

(52) U.S. Cl. ..... 92/89; 92/92; 92/93; 92/98 R

(58) Field of Classification Search ..... 92/1, 92/48, 89, 92, 93, 98 R
See application file for complete search history.

(56) References Cited

U.S. PATENT DOCUMENTS

| | | | | | |
|---|---|---|---|---|---|
| 3,284,964 | A | | 11/1966 | Saito | |
| 3,481,254 | A | * | 12/1969 | Wetherbee, Jr. | 92/92 |
| 3,495,502 | A | | 2/1970 | Bousso | |
| 3,561,330 | A | * | 2/1971 | Rich | 92/92 |
| 3,924,519 | A | | 12/1975 | England | |
| 4,502,280 | A | | 3/1985 | McCoy | |
| 4,841,845 | A | * | 6/1989 | Beullens | 92/92 |
| 4,976,191 | A | * | 12/1990 | Suzumori et al. | 92/48 |
| 5,018,506 | A | | 5/1991 | Danna et al. | |
| 5,040,452 | A | | 8/1991 | Van Kerkvoort | |
| 5,079,999 | A | * | 1/1992 | Negishi et al. | 92/48 |
| 5,158,005 | A | * | 10/1992 | Negishi et al. | 92/92 |
| 5,179,934 | A | | 1/1993 | Nagayoshi et al. | |
| 5,201,262 | A | * | 4/1993 | Negishi et al. | 92/92 |
| 5,251,538 | A | | 10/1993 | Smith | |
| 6,901,840 | B1 | | 6/2005 | Yatsko et al. | |

* cited by examiner

*Primary Examiner*—Igor Kershteyn
(74) *Attorney, Agent, or Firm*—Dwight A. Stauffer

(57) ABSTRACT

A fluid-powered mechanical actuator having a proximal end and a distal end and having a plurality of hollow tubular elements hingedly connected in end-to-end linked relationship to form a variable angle therebetween, each such link having one degree of freedom; provision to bias the elements in a direction to minimize the angle between them; a flexible elongated chamber enclosing a space within it, the chamber situated within the linked elements and within the link therebetween, substantially contained thereby, the chamber having a flexible but non-expansible wall; and apparatus to provide to the space within said chamber a pressurized working fluid; whereby the pressure of the working fluid causes said chamber to straighten within said elements, especially at said links, thereby moving the relative position of the elements in a manner to act against the biasing means, thereby to cause an increase of the angle between them by providing an increase in working fluid pressure.

20 Claims, 1 Drawing Sheet

FLUID-POWERED MECHANICAL ACTUATOR AND METHOD FOR CONTROLLING

CROSS-REFERENCE TO RELATED APPLICATIONS

This application is a continuation of commonly-owned, U.S. patent application Ser. No. 10/281,505, filed Oct. 29, 2002 now U.S. Pat. No. 6,901,840 by J. S. Yatsko et al.

This invention relates to fluid-powered actuators for positioning a portion thereof at a specific location as in positioning a tool, a part, or other object attached to the positioned portion of the actuator. Specifically, this disclosure relates to an actuator the working fluid for which inflates a chamber having a flexible but non-expansible wall, which chamber is partially enclosed in a separately-biased articulated arm that is moved by the forces exerted on the chamber by the working fluid. In an improved embodiment, feedback regarding angular displacement of an articulation of the arm is provided to a controller that adjusts the pressure of the working fluid and thereby controls the angular displacement of that articulation. Such actuators find application in an arm or hand of industrial robots.

DETAILED DESCRIPTION OF THE INVENTION

Figure 1:
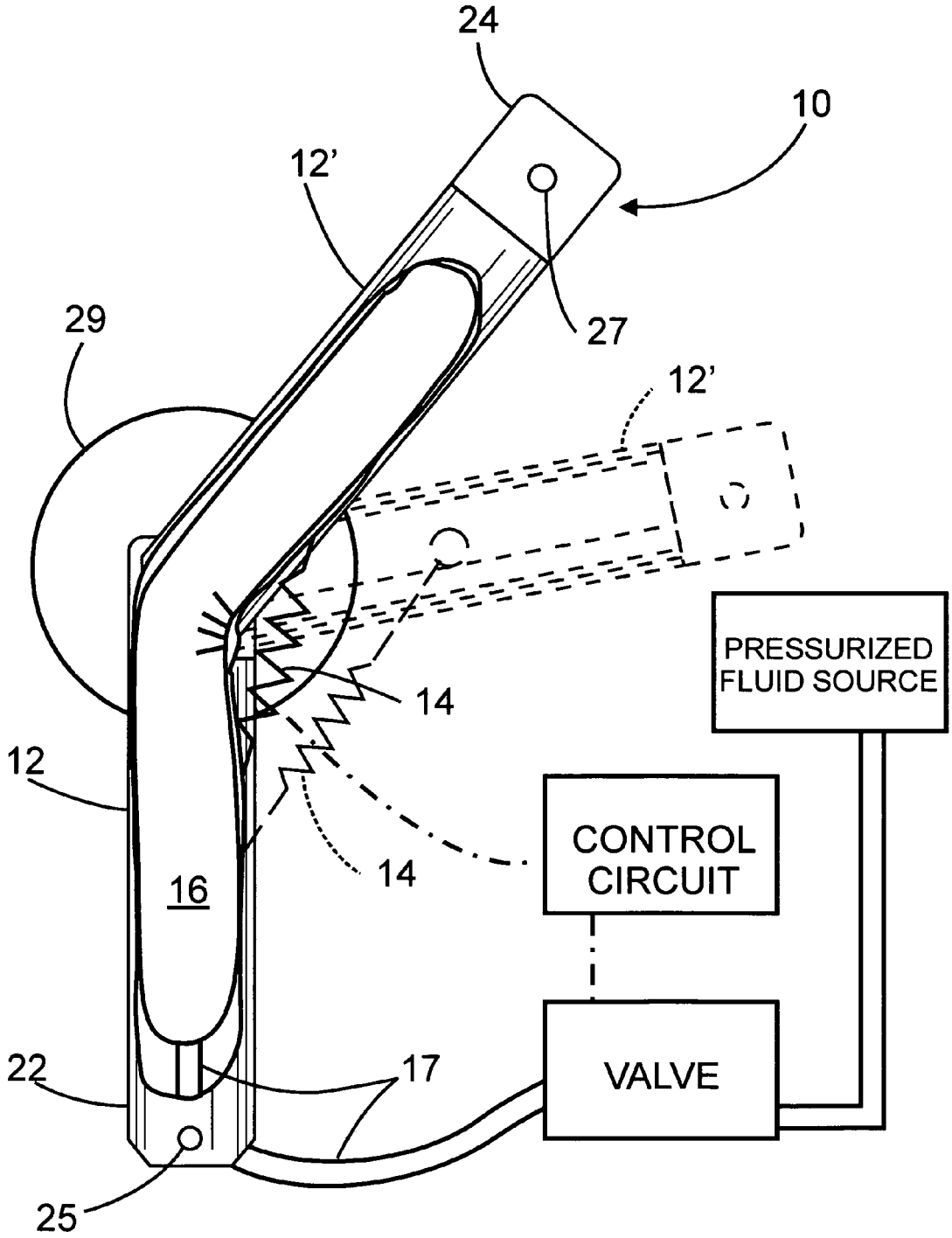
FIG. 1 illustrates, in a cutaway view, the essential features of the invention.

The actuator 10 of this invention provides a flexing motion of the actuator in a finger-like motion. That is to say, the individual articulated elements 12 12' all travel substantially in a plane. In another manner of speaking, the axis of rotation about which each pair of the articulated elements connects is substantially parallel to that of any other pair of the articulated elements, much as the knuckles on a person's finger. Transverse motion of each link within the structure of the actuator is thus denied, as is rotational motion. This type of hinged connection is often described as having one degree of freedom. Thus, the actuator 10 is made up of two or more hinged links or elements 12 12' that are biased to a bent or curved configuration by a biasing means 14 that could be a spring mechanism, an elastic mechanism involving elastomeric bands, straps, or other devices, or by a means employing gravity or pseudo-gravity, such as centrifugal force. Within this series of two or more links and substantially enclosed by the links is a fluid-filled tubular chamber 16 having a flexible but non-extensible wall. The fluid can be a gas or a liquid; air is projected to be the fluid of preference, but any gas or even a liquid, which is generally considered to be a non-compressible fluid, could be used.

The chamber 16 is connected to a fluid source capable of providing fluid under a controllable pressure. As the chamber is pressurized from this source, the fluid forces cause the chamber to straighten and thereby to straighten against the biasing means 14 the links 12 12' of the actuator, thus controllably moving one end of the actuator relative to the other. In general, one end would be in a relatively fixed location, attached in some manner to a base, this first end is usually called the proximal end 22. The opposite end of the actuator, the end at which controlled motion is desired, is usually called the distal end 24. A tool, a workpiece, or other mechanism to be positioned by the actuator for performing a task would normally be mounted on the distal end of the actuator.

The actuator of this invention comprises linked tubular elements 12 12'. Each element is a tube having transverse holes or sockets 25 on opposite sides of one end thereof and buttons, pips, or projections 27 at the other end thereof for engaging the holes in the next connecting element to create a hinged connection between elements. Instead of the projections, axle pins can be used to join the elements at some sacrificed in performance for the present invention. Thus the elements can be linked to form a lengthy channel made up of multiple elements such that the channel can bend and straighten along a path that is substantially in one plane. These elements are modular and can be assembled in many desired configurations.

The actuator comprising such assembled elements is made to bend in one direction and be substantially rigid in all other directions. It can be coiled upon itself, as is the head of a fiddlehead fern, or it can be bent at several links in only one portion along its length to form an elongated U-shape. In general, however the links are made to provide flexing in one direction only an only flex to a limited angle by means of blocking projections on each link to prevent the neighboring link from pivoting in that direction or to any greater angle. The blocking projection can be ground off to provide pivoting in the otherwise prohibited direction or to extend the angular pivoting, as has been done to make a self-supporting horizontal element or jib making a right angle with an upright element, creating a simple jib crane having a movable or raisable jib. The same configuration of a simple jib crane can be attained by a variety of means of which this is only one example.

Although the elements are here described in terms of elongated, modular elements, this is not to be seen as a restriction. Each element could just as well be a short element, hingedly linked with another element, long or short, and having a fluid-filled tubular chamber having a flexible but non-extensible wall extending through the hinge location within a portion of each element. These elongated links can be made modular, just as the links thus far described. To be sure, by the term "elongated tube," no restriction is placed on the cross-section of the tube except that the interior is hollow to receive the fluid-filled chamber. The continuity of the wall of the tube could be interrupted with perforations or other gaps for purposes of weight reduction or for other purposes including facilitating the installing of the fluid chamber within the tubes.

Thus, such a structure creates the framework or the exoskeleton of the actuator of this invention; the fluid-filled tubular chamber provides the muscle to move this exoskeleton. This muscle, however, does not contract to impart forces to the framework; rather, it pushes the framework toward an extended position by forces tending to straighten the bend at any joint.

In practice, although the actuator may be made of multiple links, each capable of hinged motion, it will likely be necessary to restrict or even totally eliminate the pivoting of some of these links to provide the desired range of motion and path of motion for the distal end. This concept brings about a great advantage of the present invention in the variety of motions that can be achieved using the same apparatus by merely locking or restricting the motion of individual links along the length of the actuator.

In the simplest mode of operation of this invention, positioning the distal end 24 at two extremes of motion is sufficient. Thus, the actuator 10 may be fully extended (or extended to all mechanical stop mechanisms that may be added to the actuator) when the chamber is under sufficient pressure to overcome the biasing means—or the actuator may be minimally extended when the chamber is under such low pressure that the biasing means 14 moves the distal end 24 of the actuator 10 to a position that substantially relieves or minimizes all or most of the biasing force. The path through which the distal end 24 moves in this simplest case is not important; only the end points of the motion are predetermined.

Clearly, the shape that the actuator assumes in the relaxed state, wherein the working fluid within the chamber is not pressurized, will depend upon the location and direction of biasing forces created by gravity and any other biasing means attached to the actuator. In this simplest case, in the fully pressurized state, wherein the working fluid within the chamber is at its maximum pressure, the actuator will tend toward assuming a straight and substantially rigid shape but it will be subject to any physical restrictions applied, including any restriction of a fully-deformed or fully-extended biasing means. The position of the distal end at each of these extremes is well defined. The position of the distal end at some intermediate pressure, however is not so well defined in this simplest case; it will depend upon the location and direction of biasing forces created by gravity and any other biasing means attached to the actuator, the pressure applied within the chamber, and the number of freely-rotating links in the actuator and will be more or less indeterminate. This mode is useful in applications where the location of the distal end at each of the end points of its travel is important, but the path between them is not.

Of greater potential use, this invention can be applied to situations wherein the location of the distal end at each of the end points is important, and the path between them is also important. This end can be accomplished by using several variations of the present invention.

Where the distal end is to traverse a path described as the arc of a circle, all links but one can be locked against rotation. In such a situation, an angular position sensor 29 can be applied at the single movable joint and a feedback loop established to control the fluid pressure, thereby to accurately control the position of the distal end along the arc through which it can travel. The end position need not be that which occurs at the point when the chamber is fully-pressurized, but it could be any position along the arc.

The versatility of this system is evidenced by the fact that a single elongated flexible-walled chamber can extend the length of the skeletal framework. Any one of the links can be chosen to be the hinged link with all other links locked against rotation. The single chamber passes through all of the links, making this variability possible.

It is also possible to have two links in the actuator to be hinged while using a single elongated flexible-walled chamber extending the length of the skeletal framework while controlling the position of the distal end to move through a path that is not the arc of a circle. An actuator having two rotatable links with each having a different degree of biasing by separate biasing means could be used to move the distal end through a first arc centered on the lesser-biased hinge and then through a second arc centered on the higher-biased hinge. The designer's imagination can create complex motions while still using only one chamber and one control device to supply pressurized working fluid to that chamber.

Yet another variation would employ a plurality of chambers, each extending through a portion of the length of the actuator framework. Each chamber would then receive pressurized working fluid through a separate tube from a separate regulated source. One rotatable joint in the length controlled by each chamber would provide even greater flexibility in and control over the motion of the distal end. An angular position sensor 29 can be applied at each movable joint and a separate feedback loop established to control the fluid pressure in each chamber, thereby to accurately control the position of the distal end along a complex path of travel.

It is contemplated that the controller for the source of the pressurized working fluid would be an electronically-controlled source capable of receiving an input value, either analog or digital, that the mechanical system would strive to match the input signal by increasing the supplied pressure, thereby moving the actuator and thereby effecting a change in the feedback from an angular position sensor. The input value can be entered by means of a manually-adjusted potentiometer, by means of a potentiometer or other electrical means that senses the position of another object or its approach, or by means of a computer-generated output or the output from a computer-programmed integrated circuit for repetitive but easily re-programmed operations.

In such a system using analog electronics, a variable resistor or a potentiometer could be used as the angular position sensor. In trials, the stem of a dial potentiometer was attached at the fixed pivot axis of to the hinged joint and the body of the potentiometer, was affixed to the movable element of the joint. Thus, as the joint moved, the resistance of the potentiometer changed accordingly. A similar potentiometer was used as the input device and an electronic circuit acting on the difference between the two resistance values operated one or more valves either to admit fluid to the flexible-walled chamber 16 via a fluid conduit 17 to increase the pressure therein or to not admit fluid and allow the pressure to drop through intentional leaks in the fluid system. Accurate angular control was achieved using this control means. Potentiometers suitable for this use include the BOURNS trimmer potentiometer, series 3309P, manufactured by Bourns, Inc., 1200 Columbia Avenue, Riverside, Calif. 92507; other comparable devices could be used with satisfactory results.

In such a system using digital electronics, the angular position sensor 29 can be an encoder wheel, such as an OMRON optical sensor, model EE-SX1061, used in the manner prescribed for such devices. These optical sensors are well know in the art and can be purchased in the United States from Digi-Key Corporation, 701 Brooks Avenue South, Thief River Falls, Minn. 56701. Other similar devices can be used effectively. The digital signal from the optical sensor 29 can be monitored by a computer or any of a number of simple digital circuits comparing the position determined by the optical sensor with a preset or adjustable digital input or target signal to provide an output signal to operate one or more valves to allow flow of pressurized fluid into or from the flexible-walled chamber 16 via a fluid conduit 17, thereby to maintain any desired angular position of the actuator.

Perhaps the simplest feedback control for fluid systems such as may be used for control of the actuator of this invention is a simple fluid pressure regulator, regulating the pressure downstream of the control valve of the regulator based on direct feedback either within the regulator itself or external to it. Many such devices are available. Movement of the actuator would be effected just by adjusting the pressure regulator to deliver a higher or a lower pressure to the flexible-walled chamber.

To be sure, feedback control systems such as those described above are not new in the art and are described here to fully disclose features of the best mode of this invention.

No doubt there are variations in apparatus and method that will be obvious to one skilled in the art. It is intended that this application embrace any such obvious variations and its scope be limited only by the claims appended hereto.

We claim:

1. A fluid-powered mechanical actuator having a proximal end and a distal end and comprising:

an elongated framework comprising a plurality of structural elements hingedly connected serially in end-to-end linked relationship to form a variable angle therebetween, each linked pair of elements comprising:

a first element and a second element;

a hinge that hingedly connects an end of the first element to an end of the second element, thereby allowing one degree of freedom for rotational movement about a hinge axis for the first element and the second element relative to each other;

a bias in the direction of minimizing the angle between the first element and the second element;

a flexible elongated chamber that extends along a portion of the first element's length, across the hinge, and along a portion of the second element's length; and a portion of the first element that holds the chamber and a portion of the second element that holds the chamber such that the chamber, and the first and second elements, are constrained to move together; wherein the chamber comprises:

a flexible but non-expansible wall that is substantially non-permeable to a working fluid;

an enclosed space within the wall; and a fluid conduit connected to the enclosed space for communicating a controlled pressure to the working fluid contained in the enclosed space, such that the chamber will tend to straighten in response to a pressurized working fluid therein, thereby exerting a force always in opposition to that of the bias.

2. The actuator of claim 1, wherein the chamber further comprises an inner wall and an outer wall, wherein:

the inner wall is flexible, and substantially non-permeable; and the outer wall is flexible, non-expansible, and substantially contains the inner wall for limiting radial expansion of the inner wall.

3. The actuator of claim 1, further comprising:

an intentional leak of the working fluid.

4. The actuator of claim 1, further comprising:

a lock that restricts the rotational movement about the hinge axis, thereby limiting the angle between the first and second elements to be within a range from a selected minimum value to a selected maximum value, wherein:

the minimum value can be equal to the maximum value, thereby locking the hinge at a selected angle.

5. The actuator of claim 1, further comprising:

an adjustable restriction at the hinge axis for controlling the rotational movement rate.

6. The actuator of claim 1, further comprising:

an angular position sensor at the hinge axis.

7. The actuator of claim 1, wherein:

a single chamber extends along at least a portion of three or more hingedly connected structural elements and across the hinges between the three or more elements.

8. The actuator of claim 1, wherein:

a first chamber extends along a portion of the first element's length, across the hinge between the first element and the second element, and along a portion of the second element's length; and a second chamber extends along a portion of the second element's length, across the hinge between the second element and a third element, and along a portion of the third element's length.

9. A method for controlling movement of a mechanical actuator having a proximal end and a distal end, the method comprising the steps of:

providing an elongated framework between the proximal end and the distal end, the framework comprising a plurality of structural elements hingedly connected serially in end-to-end linked relationship to form a variable angle therebetween;

biasing the plurality of structural elements in the direction of minimizing the angle between each linked pair of elements;

holding a flexible, non-expansible, non-permeable elongated chamber to portions of the elongated framework, such that the chamber extends across at least one hinge, thereby constraining the chamber, and the framework that is linked by the at least one hinge, to move together; and supplying a pressurized working fluid to the interior of the chamber for straightening the at least one hinge always in opposition to the bias.

10. The method of claim 9, further comprising the step of:

enabling the at least one hinge to un-straighten in response to the bias by providing a controlled leakage rate of the working fluid from the chamber.

11. The method of claim 9, further comprising the step of:

restricting the angular range of rotational movement about a hinge axis to be from a selected minimum value to a selected maximum value, wherein:

the minimum value can be equal to the maximum value, thereby locking the hinged connection at a selected angle about the hinge axis.

12. The method of claim 9, further comprising the step of:

controlling a rotational movement rate of the hinged connection by providing an adjustable restriction at a hinge axis of the hinged connection.

13. The method of claim 9, further comprising the steps of:

providing an angular position sensor at a hinge axis of the hinged connection; and using feedback from the angular position sensor to control the pressure of the working fluid.

14. The method of claim 9, further comprising the step of:

extending a single chamber along at least a portion of three or more hingedly connected structural elements and across the hinges between the three or more elements.

15. The method of claim 9, further comprising the step of:

extending a first chamber along a portion of a first element's length, across the hinge between the first element and a second element, and along a portion of the second element's length; and extending a second chamber along a portion of the second element's length, across the hinge between the second element and a third element, and along a portion of the third element's length.

16. The method of claim 9, further comprising the step of:

using gravity for biasing the plurality of structural elements.

17. The method of claim 9, further comprising the step of:

providing an independently adjustable bias for a linked pair of elements.

18. A fluid-powered mechanical actuator having a proximal end and a distal end and comprising:

a base at the proximal end comprising a structural element oriented in a selected direction; and a flexible elongated chamber that is attached to the structural element and extends beyond the structural element to the distal end of the actuator; wherein the chamber comprises:

a flexible but non-expansible wall that is substantially non-permeable to a working fluid;

an enclosed space within the wall; and a fluid conduit connected to the enclosed space for communicating a controlled pressure to the working fluid contained in the enclosed space such that when sufficiently pressurized the elongated chamber will tend to extend substantially linearly outward from the base in the selected direction.

19. The actuator of claim 18, wherein the chamber further comprises an inner wall and an outer wall, wherein:

the inner wall is flexible, and substantially non-permeable; and the outer wall is flexible, non-expansible, and substantially contains the inner wall for limiting radial expansion of the inner wall.

20. The actuator of claim 18, further comprising:

an intentional leak of the working fluid.

* * * * *